US007648339B1

(12) United States Patent
Ediger et al.

(10) Patent No.: US 7,648,339 B1
(45) Date of Patent: Jan. 19, 2010

(54) FABRIC FAN BLADES

(75) Inventors: Glen Wesley Ediger, North Newton, KS (US); Luke Edward Kelly, Augusta, KS (US)

(73) Assignee: Vornado Air Circulation Systems, Inc., Andover, KS (US)

( * ) Notice: Subject to any disclaimer, the term of this patent is extended or adjusted under 35 U.S.C. 154(b) by 287 days.

(21) Appl. No.: 11/215,513

(22) Filed: Aug. 30, 2005

Related U.S. Application Data

(60) Provisional application No. 60/605,485, filed on Aug. 30, 2004.

(51) Int. Cl.
*F04D 29/18* (2006.01)

(52) U.S. Cl. ..... 416/142; 416/240; 416/232

(58) Field of Classification Search ..... 416/143, 416/142, 240, 229 R, 232, 63, 70 R, 70 A, 416/223 R, 62; 415/141
See application file for complete search history.

(56) References Cited

U.S. PATENT DOCUMENTS 1,360,596 A * 11/1920 St John ..... 416/84
D84,642 S 6/1931 Ljungstrom
1,868,113 A 7/1932 Ljungstrom
5,947,686 A * 9/1999 Keyes ..... 416/61
6,164,594 A * 12/2000 Pignol et al. ..... 244/138 A
7,037,074 B2 * 5/2006 Hoshino ..... 416/62

OTHER PUBLICATIONS

Ribbonaire by Singer®, photographs attached.

* cited by examiner

*Primary Examiner*—Edward Look
*Assistant Examiner*—Dwayne J White
(74) *Attorney, Agent, or Firm*—Stinson Morrison Hecker LLP

(57) ABSTRACT

Cloth or fabric fan blades self-inflate when rotated about an axis to produce air movement, the blades being secured to a fan hub which is in turn connected to a fan motor assembly that provides the rotational force to inflate the blades, the blades collapsing upon contact with any object for safety purposes, the innovative blades being lightweight and safe such that no fan guard is required.

3 Claims, 8 Drawing Sheets

FABRIC FAN BLADES

CROSS-REFERENCE TO RELATED APPLICATIONS

This application claims priority to Provisional Patent Application No. 60/605,485 filed on or about Aug. 30, 2004.

STATEMENT REGARDING FEDERALLY SPONSORED RESEARCH OR DEVELOPMENT

Not applicable.

BACKGROUND OF THE INVENTION

1. Field of the Invention

The invention is generally directed to a compact portable fan, and more specifically, to a portable fan having unguarded fan blades made of cloth or fabric material that are safe in use.

2. Description of Related Art

Portable fans utilize rotating blades to produce air movement. Typically, such portable fans include fan blades made of metal or rigid plastic. The use of such materials requires a guard to cover the fan blade assembly for safety purposes to prevent accidental contact with the fan blades during rotation of the blades in normal operation. The use of metal and rigid plastic for fan blades also increases the weight of the fan such that the units may be heavy to ship or awkward to move throughout a house or office.

Unguarded fans are desirable because removal of the fan guard increases air flow from the fan blades and reduces noise resulting from vibration of the fan blades and guard. In addition, unguarded fans are generally easier and more economical to manufacture and are smaller and lighter, thus reducing shipping costs. Unguarded fans are also aesthetically pleasing to the eye of the consumer. Commercially marketable unguarded fans, however, are subject to strict safety requirements established by Underwriter Laboratory.

Although unguarded fan blades are known, the present invention improves upon the performance and safety heretofore available. For example, fan blades have been created out of foam and soft plastic such that a protective guard is not required in order to commercially market the fans. Unguarded fans manufactured by Caframo™ in Canada comprise soft plastic molded blades having shock absorbing leading edge bumpers, either covered in foam or having cut-out portions, to reduce the impact of the blades on fingers, etc. Other unguarded fans include blades made of a sheet of foam which is die cut into "blades" and inserted into the fan hub to create a low weight, low impact blade. The blades are flexible enough that a guard is not required. The blades, however, do not collapse away from a finger or other object. The unguarded fan blades presently known have drawbacks. Although the blades may be flexible, in reality, they do not generally collapse out of the way of a finger or other object coming into contact with a moving blade and there tends to be a consumer perception that the blades are rigid and pose a safety hazard. Other unguarded fans include blades made of ribbon (such as the Ribbonaire by Singer®) or leather straps. These fans also have drawbacks in that, given the safety requirements that must currently be met by Underwriter Laboratory, the known unguarded fan blades tend to be rather inefficient at moving air.

The present invention provides a soft blade which efficiently moves air and is well-suited for home or office use. The present invention provides a unique blade configuration that not only performs with improved efficiency over other unguarded blades, but also provides to the consumer an understanding that this blade design is safer than conventional foam type or soft leading edge type fan blades. The blade of the present invention collapses easier for better perceived safety.

BRIEF SUMMARY OF THE INVENTION

The present invention is directed to fabric fan blades which self-inflate when rotated to produce air movement and which are secured to a fan hub which is, in turn, connected to the fan motor assembly that provides the rotational force to create the air movement needed to inflate the fan blades. The blades collapse upon contact with an object for safety purposes.

The fan blades are formed of one or more pieces of cloth material, such as nylon. Preferably, two pieces of cloth are secured together to form a sock-like structure wherein the sides and the exterior end are closed—such as by stitching, application of adhesive or the like—and are substantially air impermeable. The hub end of the blade is at least partially open to allow air flow into the blade channel created therein upon rotation of the blades about an axis. There are preferably three blades which are secured to a fan hub, which is connected to a motor assembly of a fan of known construction. The blades are secured to the fan hub so as to allow air to flow into a channel presented by the blade, while securely retaining the blades on the fan hub during hub rotation.

The innovative fabric blades of the present invention effectively produce air movement and are light weight and safe such that no fan guard is required. The advantage of this inflatable blade is that when an object, such as a finger, comes into contact with the blade, the blade will collapse, reducing the risk of injury. The minimal mass of the fabric blade combined with the softness of the cloth material creates a safer, unguarded, blade design than previously known.

Additional aspects of the invention, together with the advantages and novel features appurtenant thereto, will be set forth in part in the description which follows, and in part will become apparent to those skilled in the art upon examination of the following, or may be learned from the practice of the invention.

DETAILED DESCRIPTION OF PREFERRED EMBODIMENT

Figure 1:
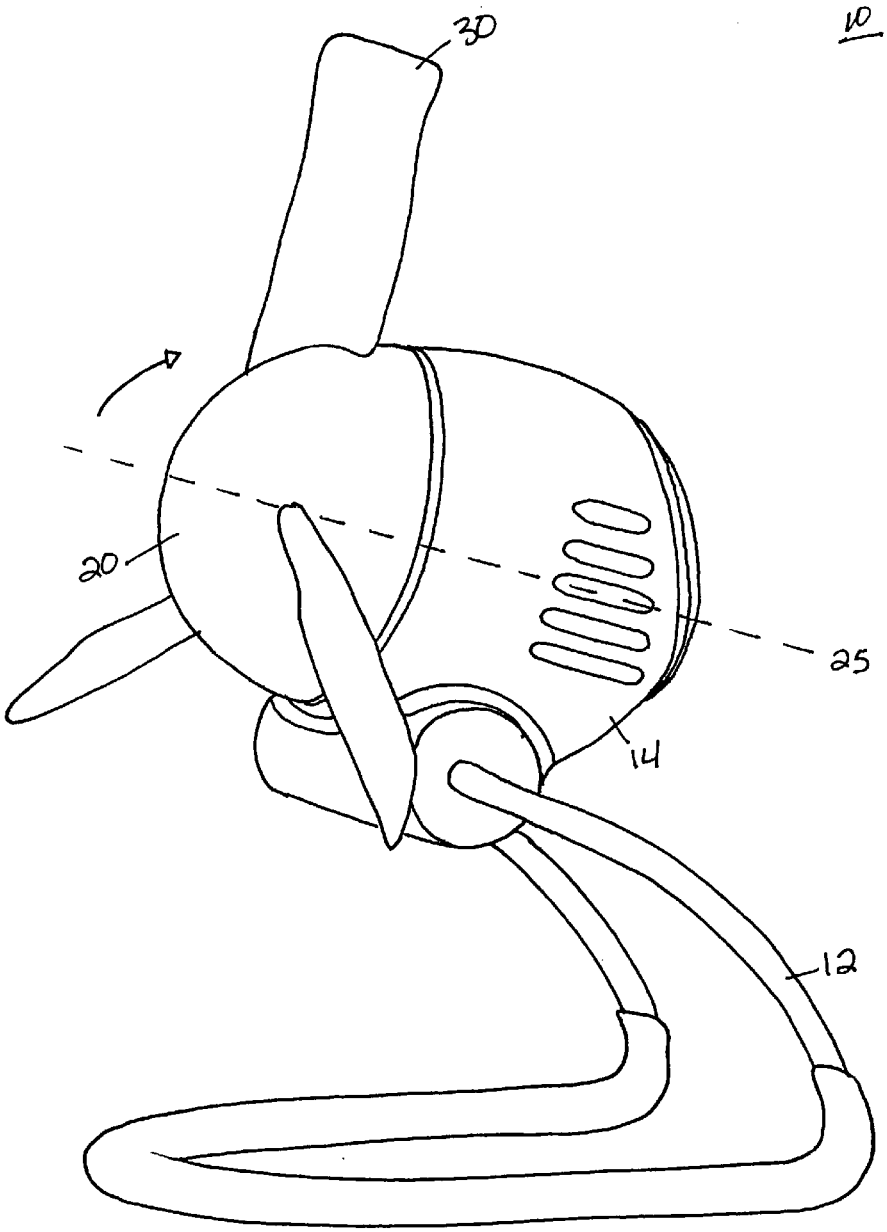
FIG. 1 is a front perspective view of a portable fan device utilizing fabric fan blades in accordance with one embodiment of the present invention.

Referring first to FIG. 1, there is shown an electric or battery-operated fan unit generally referred to by reference numeral 10. Fan unit 10 includes a base 12, motor housing 14 which houses a motor assembly (not shown) and a hub 20.

Hub 20 is mechanically connected to the motor assembly such that the motor drives the rotation of the hub. Base 12, motor housing 14, and the motor assembly are of the usual and known construction followed in the manufacture of electric and battery-operated fans and form no part of the present application but are mentioned merely for purposes of illustration. It should be appreciated that the present invention may be utilized with any fan configuration, provided the fan utilizes a hub 20 or other similar structure which is or can be mechanically connected to a motor assembly or other rotational power source.

Figure 2:
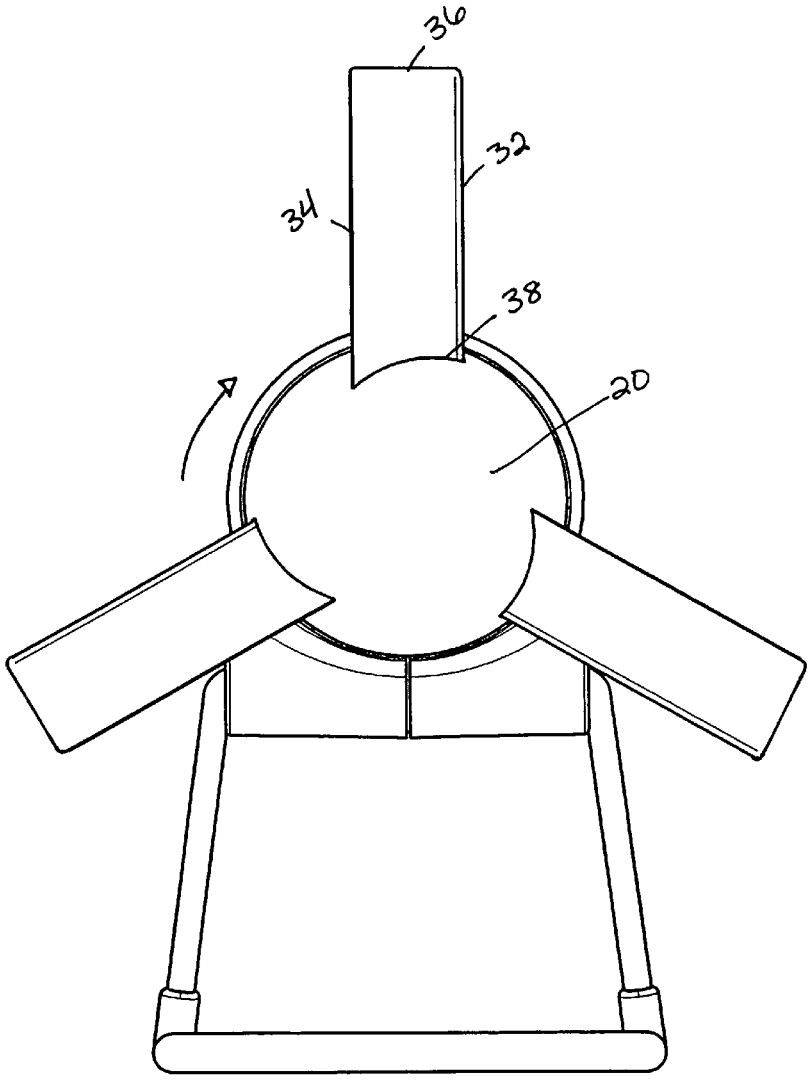
FIG. 2 is a front of the device of FIG. 1.
Figure 4:
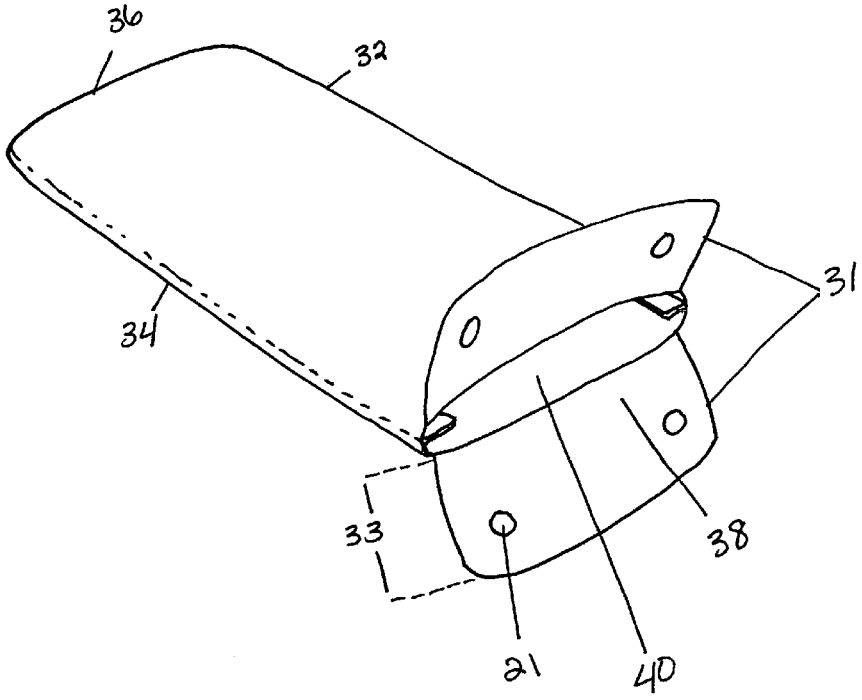
FIG. 4 is a perspective view of a blade of the device of FIG. 1.
Figure 5:
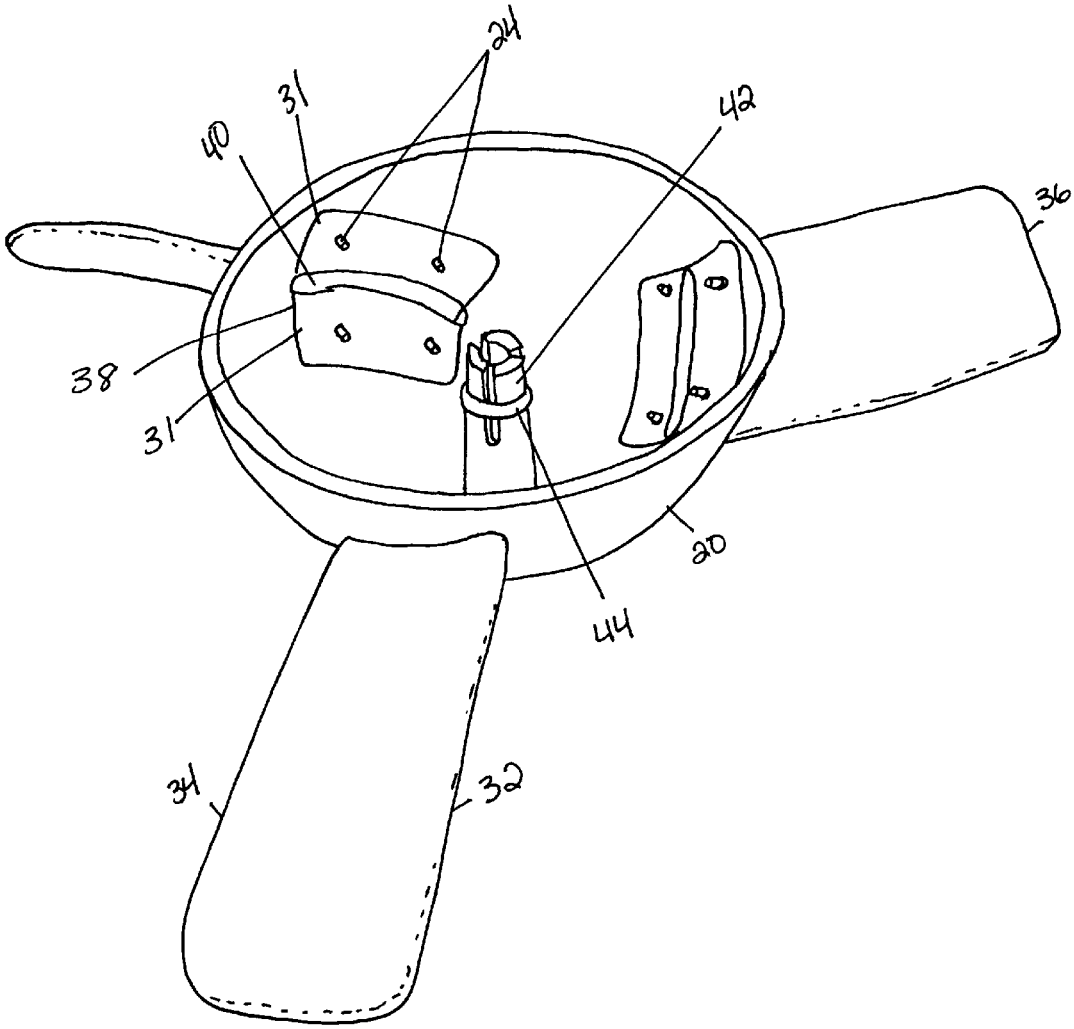
FIG. 5 is a perspective view of the hub and blades of the device of FIG. 1.

Hub 20 secures a blade 30 in a fixed position relative to the hub and allows the blade to rotate with hub 20 about axis 25. Each blade 30 comprises a leading edge 32, a trailing edge 34, an exposed closed end 36, an open hub end 38, and a blade channel 40. Blade 30 is generally rectangular in shape when viewed from the front or back, and generally linear in longitudinal profile, as depicted in FIGS. 2, 4, 5. Upon rotation and inflation, blade 30 retains its generally rectangular overall shape, but the longitudinal profile takes on a slightly elliptical shape due to air in channel 40 and the resulting inflation of the blade. The rectangular shape of blade 30 follows naturally from securing two separate pieces of material together to form blade 30. The cross-sectional shape of exposed end 36 is also generally rectangular. As shown, edges 32, 34 of the blade are generally symmetrical.

Blade 30 is made of a cloth or fabric material which is flexible, yet resilient. Blade 30 is constructed of two separate pieces of fabric which are secured together at the edges 32, 34 and end 36, creating blade channel 40. The construction may resemble a wind sock or tube of sorts. Exposed end 36 is closed, while hub end 38 remains open to allow air flow into the blade channel 40. Channel 40 is created to form a cavity that is substantially air impermeable so that blade 30 remains in an inflated state during rotation of hub 20.

Figure 6:
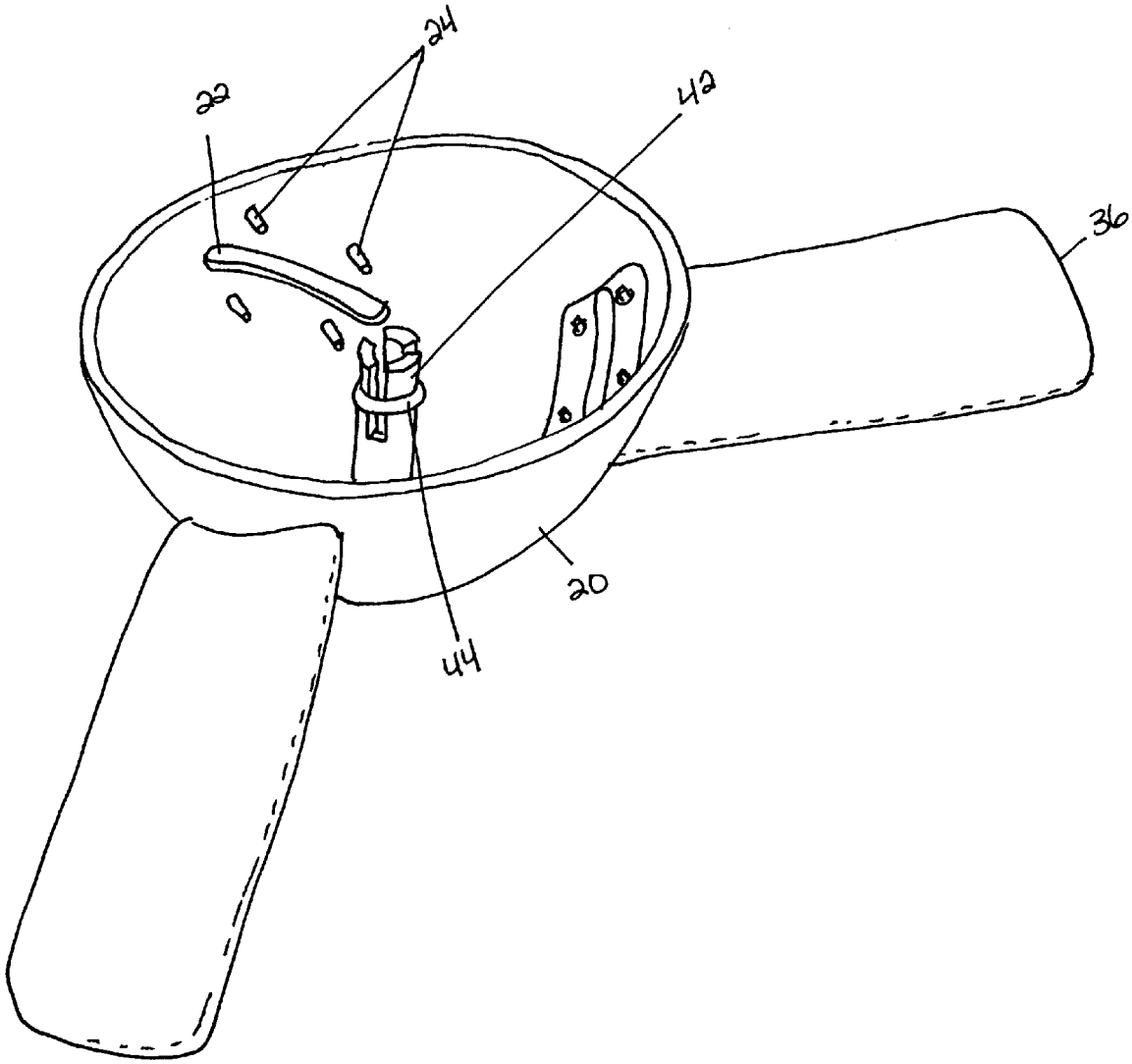
FIG. 6 is a perspective view of the hub and blades of FIG. 5, showing the aperture.

As shown in FIG. 4, hub end 38 of each blade 30 has a plurality of flaps 31 formed by longitudinal edges 32, 34. Throughout the length each flap portion 33, longitudinal edges are not secured together at the edges and remain open—creating flaps 31 on a front side of blade 30 and a rear side of blade 30. As shown in FIG. 4, a short length of longitudinal edges 32, 34, preferably approximately 20 to 25 percent of the overall length of blade 30, remains unconnected and open to form flaps 31. As depicted in FIGS. 5 and 6, flaps 31 are secured on the interior side of hub 20 and remain on the interior side of hub throughout rotation of hub 20 and blades 30. Flaps 31 allow blade 30 to closely abut hub 20 and thereby facilitates of secure attachment of blade 30 to hub 20 by way of pins 24, described in more detail below.

Each blade 30 is made of a durable, yet flexible fabric or material. The material is substantially air-impermeable so as to retain a sufficient volume of air in channel 40 to inflate the blades upon rotation of hub 20. The blade material is preferably nylon and more preferably rip stop nylon. Other possible fabrics include felt, cotton, knit, latex, or virtually any other flexible cloth material which is also substantially air impermeable. As shown in FIGS. 1 and 2, blade 30 is not longer than approximately half the height of fan unit 10, such that blades 30 do not hit fan base 12 or other supporting surface, such as a table (not shown), during rotation and use. For example, if fan unit 10 is a desk-top fan approximately 10 inches in overall height (measured from base to tip of blade), blade 30 would preferably be no longer than 4 inches in length from exposed end 36 to end of flaps 31. Of this blade length, approximately 3 inches would be visible outside of hub 20, as the remainder would comprise flaps 31 and remain on the interior side of hub.

Figure 3:
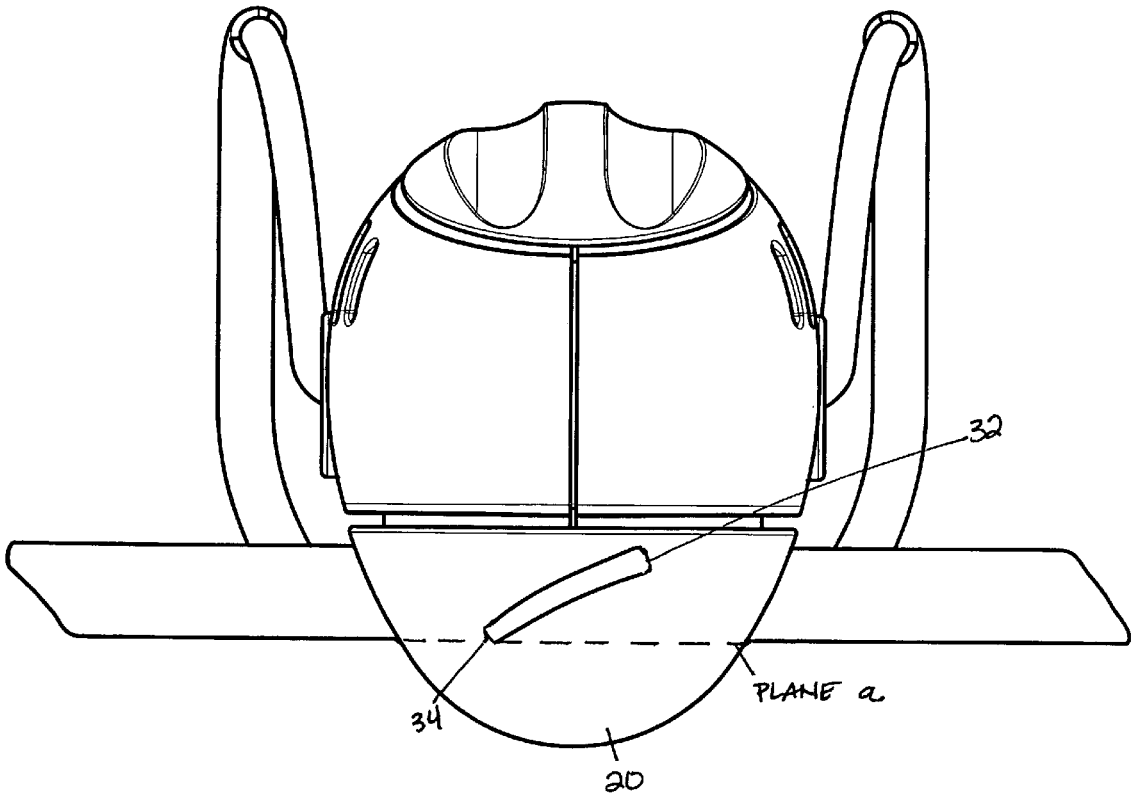
FIG. 3 is a top view of the device of FIG. 1.

Blade 30 is secured to hub 20 at hub end 38. As shown in FIGS. 1-3, the preferred embodiment of the present invention comprises three blades. Blades 30 are secured in a fixed position around hub 20 and blades 30 are located approximately equi-distant from each other. For example, in the preferred embodiment depicted having three blades, the blades are located approximately 120 degrees apart. Similarly, if four blades are utilized, each blade would be spaced approximately 90 degrees apart, and so forth. Blades 30 are oriented to hub 20 with a pitch appropriate to the rotation so as to induce appropriate air movement of blades 30. As shown in FIGS. 1 and 3, leading edge 32 is located more rearward of fan unit 10 than trailing edge 34. The angle defined by this difference in position is the pitch of the blades, measured relative to an imaginary vertical plane a that would pass through trailing edge 34 of all blades. The pitch of blades 30 is preferably between 10 and 50 degrees and more preferably between 30 and 40 degrees, although other pitches may be sufficient to create adequate air movement.

Blades 30 are attached to hub 20, which is rotationally driven by a motor source (not shown). Hub 20 is made of a molded plastic. Hub 20 is slightly egg-shaped for aerodynamic and aesthetic purposes. Hub 20 includes three apertures 22, one for each of blades 30. In the preferred embodiment, hub 20 comprises three apertures 22. As shown in FIG. 6, apertures 22 are oblong and have a slight concave curve towards the rear of hub 20 in order to snugly accommodate blades 30.

Referring now to FIGS. 5 and 6, hub 20 includes a plurality of molded pins 24 to secure blade 30. Pins 24 are molded as an integral part of hub 20. Hub 20 contains four pins 24 (two on each longitudinal side of aperture 22) per aperture 22. Pins 24 are relatively short in length, being long enough to sufficiently pass through thickness of blade and provide adequate distance to prevent accidental dislodging of blade 30 from pin 24. Pins 24 are spaced apart sufficiently from each other to be located near the edges of flaps 31 to provide stability to blade 30 connection to hub 20. The terminal end of pin 24 is generally flat for safety purposes. Pin 24 extends from hub 20 in a generally perpendicular orientation, as shown in FIGS. 5 and 6.

Apertures 22 retain blades 30 in a fixed position relative to other blades 30 and relative to hub 20. Accordingly, apertures 22 are positioned around hub 20 in the same orientation as that of blades 30. For example, in the preferred embodiment, apertures 22 are located approximately 120 degrees apart and preferably have a pitch of between approximately 30 and 40 degrees. As shown in FIGS. 5-6, exposed end 36 of blade 30 passes through aperture 22 from the interior side of hub 20. Blade 30 is secured over molded pins 24 by fastening flaps 31 over pins 24, utilizing pre-made apertures 21 in the blade material. Hub end 38 is reinforced with adhesive cloth or foam tape (not shown) stitched or adhered to either the exterior of flap 31 or the inside of hub 20, such that the adhesive is in contact with both the flap 31 and the inside of hub 20. This contact creates a rigid or semi-rigid area and further secures blade 30 to hub 20. In this manner, blade 30, and more specifically flaps 31, will not pass entirely through aperture 22 and hub end 38 and flaps 31 will be retained on interior side of the hub.

Hub 20 further comprises means for mechanically connecting the hub to the motor assembly so as to enable the hub to rotate. As shown in FIGS. 5 and 6, hub 20 comprises an axle support 42 which is secured onto motor assembly axle (not shown). An O-ring 44 is utilized to further secure hub 20 onto axle. Of course, it should be understood that any number of attachment methods to motor assemblies are possible and are within the scope of the present invention, including those known and used in the art, provided that hub 20 and blades 30 are securely attached to motor assembly such that motor assembly can rotate hub 20 and blades 30 about an axis 25.

Operation of Blades

As shown in FIGS. 1 and 2, blades 30 rotate in a clock-wise direction when viewing fan unit 10 from front. Of course, counter-clockwise rotation is also within the scope of the invention, provided the orientation of blades 30 is repositioned accordingly. When at rest, blade 30 may appear either limp or generally inflated, depending on the specific material utilized. When at rest, blades 30 are flexible and generally ineffective as air-moving devices. Upon rotation of hub 20, centrifugal forces force blades 30 into an outward direction from the rotating hub 20, creating a stiffer blade suitable as an air moving device. Blades 30 are also held rigid by the addition of centrifugal forces on the air that is inside blades 30. This air in the blades 30 assists in inflating the blades to a more rigid and aerodynamically functional blade shape, further enhancing the performance and efficiency of the blade.

Other Embodiments

In another embodiment, blade 30 may be formed of a single piece of material (not shown). The material may be a knit, latex, or other substantially air impermeable material that has a tube-like construction, or it may be a single-layer of material which is folded and secured along two edges to form channel 40. For example, the fabric may be folded along one of longitudinal side 32 or 34 and the free edges of the second longitudinal side (the other of 32 or 34) and exposed end 36 secured together to form channel 40. Alternatively, the single piece of fabric may be folded at the exposed end 36 and the free edges of both longitudinal sides 32, 34 secured together to form channel 40. In all instances, hub end 38 remains at least partially open to allow for air flow into channel 40. It is also within the scope of the present invention for hub end 38 to be partially closed, provided there is at least minimal air flow into channel 40.

It is also within the scope of the present invention to utilize more than two pieces of fabric (not shown) which are secured together to form blade channel 40. For example, three pieces of fabric—such as one top piece, one bottom piece and one exterior end piece—may be secured together at all edges except hub end 38, which remains open. Other configurations include any number of pieces of fabric, of virtually any shape, assembled together to form blade 30 having channel 40, wherein all sides are closed or secured together with the exception of hub end 38 which remains at least partially open. The number and shape of pieces would be constrained only by ease and cost of manufacture.

Additional means of securing edges of material together to form channel 40 include glue or other adhesive, heating and melting the material fibers together, or otherwise securing the pieces together in a substantially air-tight manner such that blade 30 may remain in a temporary inflated state throughout rotation of hub 20. The method of securing blade 30 edges should be selected accordingly depending on the specific blade material selected. For example, certain material may be better secured by stitching as opposed to the use of an adhesive or heat, and vice versa.

While blade 30 is preferably generally rectangular in shape, other blade shapes are also within the scope of the present invention, such as oval, elliptical, trapezoidal, airplane-wing shaped and the like. It is also within the scope of the present invention for blade 30 to have a generally rectangular shape, but for exposed end 38 to be rounded or angled as opposed to generally linear. The shape of blade 30 is limited only by manufacturing and efficiency constraints.

Of course, it is also within the scope of the present invention for blade 30 to have other cross-sectional shapes, such as that of an airfoil (having a wider leading edge 32 than trailing edge 34 and resembling a tear-drop), triangular, elliptical and the like. Blade shape may be controlled by a stitching or adhesive pattern. Accordingly, it is also within the scope of the present invention that blade 30 may include a separate end piece (not depicted) secured at exposed end 36 to material pieces and attached as heretofore discussed. The end piece may be shaped such that blade 30 cross-sectional shape at exposed end 36 is dictated by the shape of the end piece. Similarly, leading edge 32 and trailing edge 34 may be elliptical, or generally rectangular depending on whether one or more pieces of material are utilized and depending on the securing means utilized. Other shapes are also within the scope of the present invention, however their use may be constrained by ease and cost of manufacture as well as efficiency of air movement.

It is within the scope of the invention to have as few as two blades and as many blades as hub 20 will accommodate. Increasing the number of blades over three, however, has been found to produce diminishing returns. Although not preferable because of decreased efficiency, it is also within the scope of the present invention to utilize only one fabric blade, provided a counter-balance (not shown) is placed on the opposite side of hub 20. Additionally, although not preferable for safety reasons, blades 30 may be removably secured to hub 20 so that blades may be easily replaced.

While the preferred hub 20 construction has been described above, it should be noted that the hub, may be of any shape, although it is preferably rounded in some manner for safety reasons. Additionally, apertures 22 may be other shapes, such as elliptical or trapezoidal, provided they snugly accommodate blades 30, while at the same time allowing for air flow between the atmosphere and blade channel 40.

It is also within the scope of the present invention to have only one pin 24 per aperture 22, or an unlimited number of pins—limited only by space and manufacturing constraints. In addition, pins 24 may be pointed such that blade 30 may be fastened over pins 24 without the need for pre-made apertures in the blade material. Similarly, while pin 24 is preferably columnar in shape, other shapes such as rectangular, triangular, hexagonal, and the like are also within the scope of the present invention. It is also within the scope of the present invention for pin 24 to extend from inside of hub 20 at an angle other than perpendicular, provided blade 30 can be adequately secured onto pin 24.

Other means of securing blade 30 to hub 20 are within the scope of the invention, provided airflow between the atmosphere and blade channel 40 is maintained and blade 30 is securely attached to hub 20 so that is does not become dislodged during rotation of hub 20 or inflation of blade 30. For example, blade 30 may be secured to hub 20 by a piece of plastic, by heat stick, by an adhesive or by other means known and used in the manufacturing industry, with or without the use of pins 24. Another means of attachment is to utilize a plastic insert (not shown) on the interior of hub 20 which snap-fits into aperture 22 through which blades 30 pass, thereby "sandwiching" blade 30 between aperture 22 and the plastic insert. The snap-fit, however, cannot be so tight that no air flow is allowed and all fluid communication between the exterior atmosphere and the blade channel 40 is extinguished. Other means of attachment include those methods known in the industry for attaching a fabric sock, bag or channel to a rigid member such that fluid communication into the fabric sock, bag or channel is maintained, including but not limited to providing a notched inner end of blade connected inside hub, glue or other means of adhesive, sewing the blade inside hub, or molding the perimeter of open end of blade to hub. It is also within the scope of the present invention to utilize metal or plastic plates over the molded pins for added security.

Figure 7:
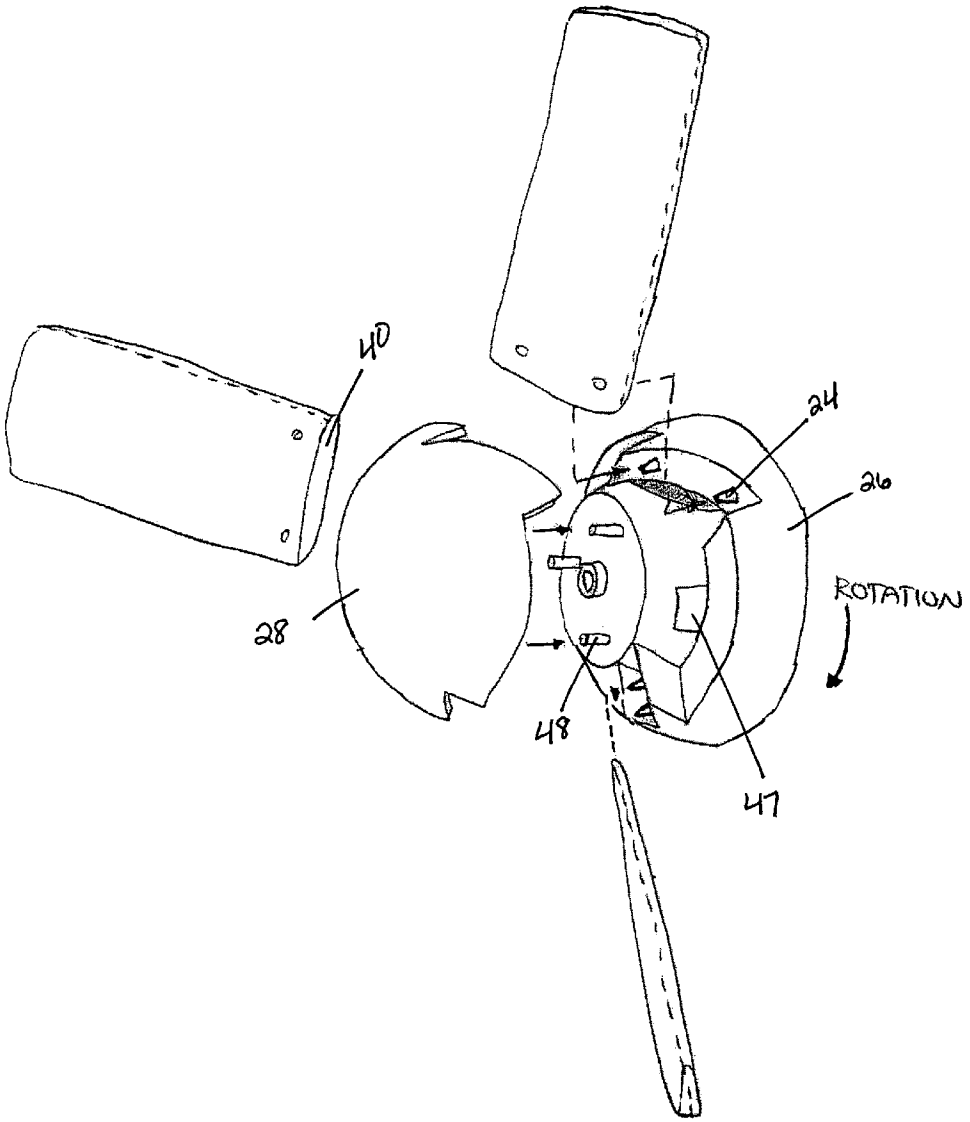
FIG. 7 is an exploded view of the hub of a second embodiment of the present invention.
Figure 8:
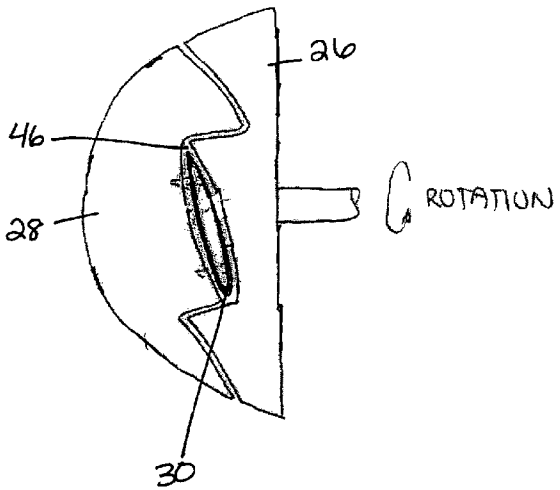
FIG. 8 is a side view of the hub of the embodiment depicted in FIG. 7.

In another embodiment of the invention, depicted in FIGS. 7 and 8, hub 20 comprises a hub base 26 and a hub cap 28. Hub base 26 and hub cap 28 are contoured to present three separate air passageways 46 when secured together. Air passageways 46 remain open and allow air flow into blades 30 and facilitate inflation even when hub base 26 and hub cap 28 are secured together. Hub base 26 further provides an air entryway 47 which is in fluid communication with the atmosphere and with air passageway 46 and, consequently, blade 30 when assembled. Ambient air flows from the center of hub 20, through air entryway 47 and air passageway 46, into blade 30. Blades 30 are secured to hub base 26 by mounting hub end 38 of blade onto molded pins 24. The hub base portion of each of the three air passageways 46 includes two pins 24 which are molded into hub base 26. Pre-made apertures 21 in blades 30 are secured over pins 24 to secure blade 30 to hub base 26. Alternatively, pins 24 may include a sharp end such that pre-made apertures 21 in blade 30 are not necessary. Hub cap 28 is attached over blades 30 to hub base 26 via three pin and socket attachments 48, and is held in place by friction. As discussed above, it is within the scope of the present invention to utilize other means of securing blade 30 to hub 20, such as adhesive and the like. Hub assembly 20 is then attached to the motor shaft, as previously discussed, to provide rotation.

Optionally, blade 30 may include a weighted insert (not shown) preferably located inside blade channel 40 near exposed end 36. A weighted insert at blade tip, while not necessary, will assist in making blade 30 more rigid and will assist in increasing air movement of blades 30. The weighted insert may be made of foam, folded or layered fabric, or other material, as long as it provides additional weight, while at the same time remaining substantially soft and flexible. Weighted insert may also be located along leading edge 32.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and sub-combinations are of utility and may be employed without reference to other features and sub-combinations. This is contemplated by and is within the scope of the invention.

What is claimed is:

1. A fan blade assembly, comprising:

at least three flexible fan blades wherein each fan blade comprises two pieces of substantially air impermeable material secured together to present a sock-like cavity, said cavity presenting an opening in a hub end through which air enters to inflate said blade when said blade is rotated;

said at least three fan blades each secured to a fan hub having at least three apertures spaced equidistant from each other and oriented at a pitch of between approximately 30 and 40 degrees wherein each of said at least three fan blades passes through one of each of said at least three apertures from the interior side of said hub such that each of said blades extends radially outward from said hub;

said hub further comprising two pins located on each longitudinal side of each of said at least three apertures, each pin extending toward the interior of said hub, said pins passing through the material at said hub end of each blade, wherein the surrounding atmosphere is in fluid communication with said cavity; and said fan hub is capable of mechanical connection to a motor assembly to facilitate rotation of said fan hub.

2. The fan blade assembly of claim 1, wherein said hub comprises a first complimentary piece and a second complimentary piece secured together and presenting an air passageway corresponding to each of said at least three flexible fan blades, said air passageway being in fluid communication with the atmosphere and each of said fan blades secured in said air passageway between said first complimentary piece and said second complimentary piece such that the atmosphere remains in fluid communication with said cavity.

3. A fan blade assembly, comprising:

at least three flexible fan blades wherein each fan blade comprises two pieces of substantially air impermeable material secured together to present a sock-like cavity, said cavity presenting an opening in a hub end through which air enters to inflate said blade when said blade is rotated;

said at least three fan blades each secured to a fan hub having at least three apertures spaced equidistant from each other and oriented at a pitch of between approximately 30 and 40 degrees wherein each of said at least three fan blades passes through one of each of said at least three apertures from the interior side of said hub such that each of said blades extends radially outward from said hub;

said hub further comprising a first complimentary piece and a second complimentary piece secured together and presenting at least three air passageways, one of each of said at least three air passageways corresponding to each of said at least three fan blades, each of said air passageways being in fluid communication with the atmosphere, each of said at least three fan blades secured in said corresponding air passageway between said first complimentary piece and said second complimentary piece by a plurality of pins such that the atmosphere remains in fluid communication with said cavity, wherein said fan hub is capable of mechanical connection to a motor assembly to facilitate rotation of said fan hub.

* * * * *